United States Patent [19]

Chervendinev et al.

[11] 4,406,552

[45] Sep. 27, 1983

[54] PRINTING DEVICE

[75] Inventors: Peter G. Chervendinev; Ventzislav G. Yankulov; Toma T. Ostromski, all of Sofia, Bulgaria

[73] Assignee: CUV "Progress", Sofia, Bulgaria

[21] Appl. No.: 231,413

[22] Filed: Feb. 4, 1981

Related U.S. Application Data

[63] Continuation-in-part of Ser. No. 936,598, Aug. 24, 1978, abandoned.

[30] Foreign Application Priority Data

Aug. 25, 1977 [BG] Bulgaria ..... 37 228

[51] Int. Cl.[3] ..... B41J 1/16

[52] U.S. Cl. ..... 400/172; 400/171

[58] Field of Search ..... 400/147, 149, 171, 172, 400/109, 175, 110, 111, 140–141, 144.2; 101/382 MV

[56] References Cited

U.S. PATENT DOCUMENTS

| | | | |
|---|---|---|---|
| 3,157,264 | 11/1964 | Frechette | 400/172 |
| 3,422,945 | 1/1969 | Bethune | 400/141 |
| 3,666,069 | 5/1972 | Suzuki | 400/141 X |
| 3,696,204 | 10/1972 | Wallskog | 400/141 X |
| 3,809,203 | 5/1974 | Ogawa et al. | 400/110 |
| 4,015,699 | 4/1977 | Kondur | 101/109 X |
| 4,281,938 | 8/1981 | Phillips | 400/171 |
| 4,289,412 | 9/1981 | Dollenmayer | 400/171 |

OTHER PUBLICATIONS

Hunt, IBM Tech. Discl. Bulletin, vol. 22, No. 10, 3/80, pp. 4349–4350.

*Primary Examiner*—Edward M. Coven

[57] ABSTRACT

A printing device such as a typewriter and the like, comprising a printing unit with a positioning manipulator, an impacting unit, and a supporting surface. The printing unit is provided with a cassette in which a plurality of card-like printing elements are located. Each printing element has a plurality of vertical rows of printing characters and a plurality of horizontal rows of printing characters. A vertically mechanically reciprocated manipulator latches on to a selected printing element and raises it to bring the horizontal row containing a selected character to the height of the printing station. The selected printing body is moved laterally in its plane to bring the selected printing character into line with the printing station. Moving or positioning of the printing elements is achieved by means of linear-step electric motors.

6 Claims, 16 Drawing Figures

PRINTING DEVICE

This application is a continuation-in-part of application Ser. No. 936,598, filed Aug. 24, 1978, now abandoned.

This invention refers to a serial character printer designed for typewriters, for input/output devices of electronic computers and other character printers, operating with a large number of characters, for example, for printing the characters of the Japanese or Chinese languages.

Character printing devices are known which have a large number of levers; on each one of these levers a block with two printing characters is affixed, this block by hammering on a printing ribbon, leaves a specific print-out on the print-out carrier such as paper.

Disadvantages of these character printers are that they have a limited volume of characters, with which they can operate, the set of printing characters cannot be changed, and as a result very often it is necessary to write by hand in order to complete the text, due to the need of letters from other alphabets or other special characters. In addition, they have a very complex design, due to the large number of mechanical components.

Other printing devices are known which have a single printing element, which contains a specific set of printing characters and is designed in the shape of a golf ball or a disk; and which element can be manually interchanged with another printing element of the same type but containing a different set of printing characters.

The main disadvantages of these prior printing devices are that replacement of the printing element is manual and takes time, particularly when the text being printed requires frequent use of characters from different printing elements, and that such printing devices have complex designs and are expensive to produce.

A character printing device is known which operates with a large set of printing characters placed on a set of automatically replaced printing elements, each of these elements being designed as a printing wheel. The printing wheels are placed in a rotating cartridge or magazine, which can be located on the side of the device. The positioning of one selected wheel along the length of the line being printed is effected by a carriage. Replacement of an operating printing wheel with another is achieved by means of a manipulator which carries the printing wheel from the carriage and inserts it into the cartridge or magazine, the manipulator then taking a new printing wheel, selected for use, from the magazine or cartridge into the carriage.

The main disadvantage of this printing device is the use of a manipulator whose only purpose is to carry the printing elements between the cartridge and the carriage, which makes the device more complex and limits its printing speed and reliability.

The present invention has among its object the avoidance of the disadvantages of prior art printing devices described above, by providing a character printing device which operates with a large number of automatically replaceable and relatively inexpensive printing elements, which contains fewer mechanical components and which has better operational characteristics.

These objects are attained through the character printing device of the present invention. Such device has a support for the carrier of the print-out (paper), a hammering device with a printing hammer, a ribbon, and a positioning component, such component containing at least three replaceable character printing elements, each one of which contains a set of printing characters, and at least some of the printing characters are not on another character printing element. The positioning component has means for placing and positioning a large number of mutually replaceable character printing elements, and means for direct and selective operation with the character printing element in a plane situated between the bearing for the print-out carrier and the printing hammer. The character printing element can be designed as a printing card which has a flat rectangular construction with elastically affixed printing characters placed in rows and columns. The component for the placing and positioning of the printing elements includes a rectilinearly-reciprocating moving cartridge, which has means for holding and keeping parallel the printing elements which are placed into it; the means for holding the printing elements includes at least two permanent magnets, which are disposed in the bottom part of the cartridge.

The device for direct and selective operation with the printing elements contains one manipulator disposed under the cartridge, the manipulator having means for orientation, centering and holding the printing elements so that it can pull out of the cartridge one selected printing element, carry it during its positioning between the print-out carrier and the printing hammer, and place it back into the cartridge when it is necessary to replace it with another printing element. The component for the placing and positioning the printing elements also includes a linear step electric motor for the positioning of the cartridge in a direction which is perpendicular to the plane in which the manipulator operates, the cartridge being attached to the inactive or movable part of the electric motor, the movable part being carried and directed by the active or stator part of the electric motor. The device for direct and selective operation with the printing elements also includes a carriage for positioning the manipulator with respect to the printing hammer and the cartridge, whereas the carriage contains the active parts of the two linear step electric motors in order to insure independent motions in two mutually perpendicular directions.

The first of such directions is horizontal, printed parallel to the printed line, and the second direction is vertical. The printing element consists of a frame enclosing a printing zone, in which the printing characters are placed, and a bearing zone, disposed beneath it, which contains elements for interaction with the cartridge and/or with the manipulator. The cartridge is open from three of its sides, the open sides being the bottom, the top and the left or the right side with respect to the direction in which the printing hammer moves, while the manipulator can enter the cartridge from below and move upwards to pull out the printing element through the upper side and/or through the third, left or right, open side. The cartridge can also be open only from two sides, the open sides being the bottom and top; in such case, the manipulator clamps one selected printing element from below and takes it out through the top side of the cartridge. The means by which the manipulator clamps one selected printing element includes at least one element made of a permanent magnet, while every printing element has in its bearing zone at least one part made of magnetic material.

The main advantage of the invention is that it permits the design of more advanced printing devices with different designs, with fewer mechanical components, and with better operational characteristics. Such devices operate with a large number of printing characters, including several alphabets, different styles of printing, mathematical, technical and other special characters, or include the characters of the Japanese, the Chinese, or other language employing an alphabet other than that of the English language.

The invention is illustrated in greater detail with the aid of the following description of two preferred embodiments thereof and the attached drawings, wherein.

Figure 1:
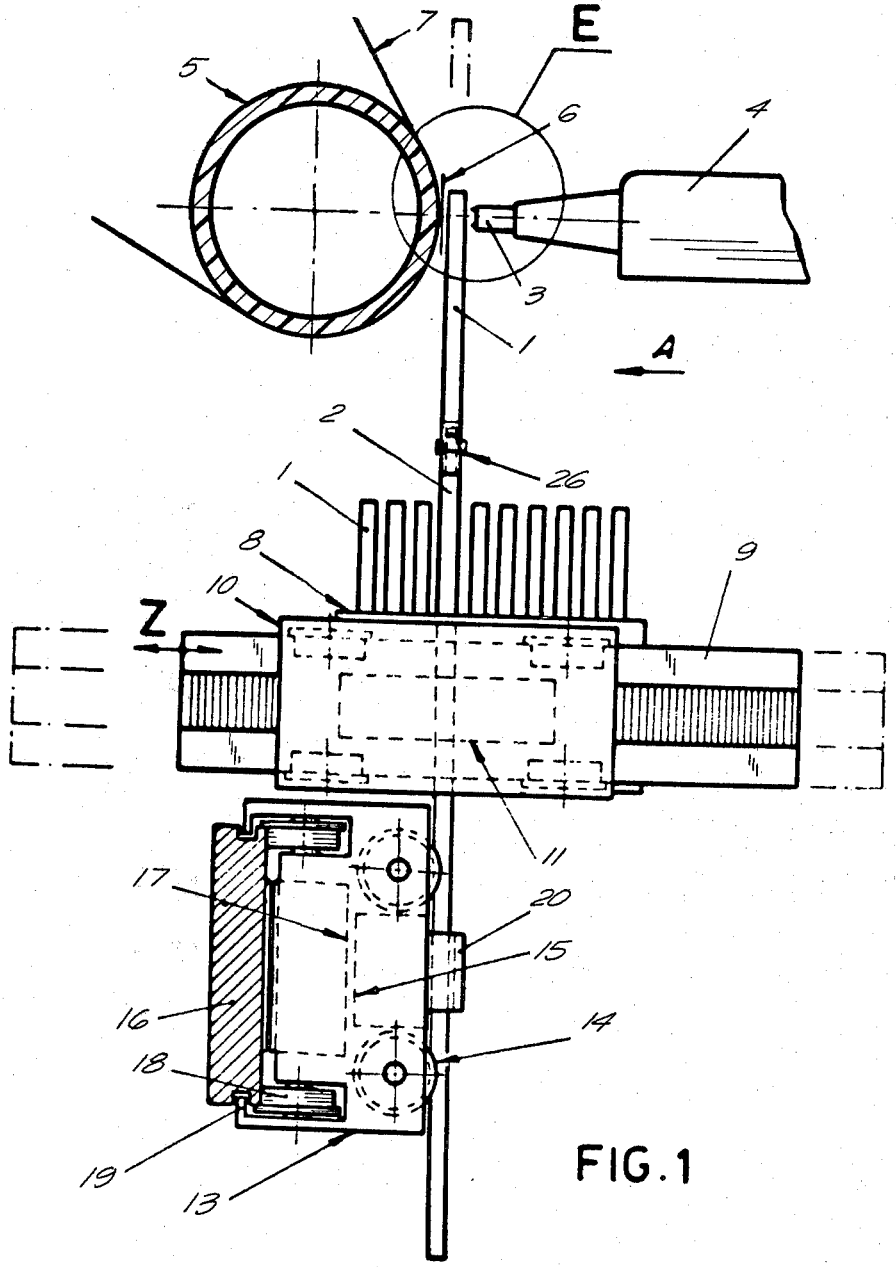
FIG. 1 is a side view of a first embodiment of the character printing device according to the present invention.
Figure 2:
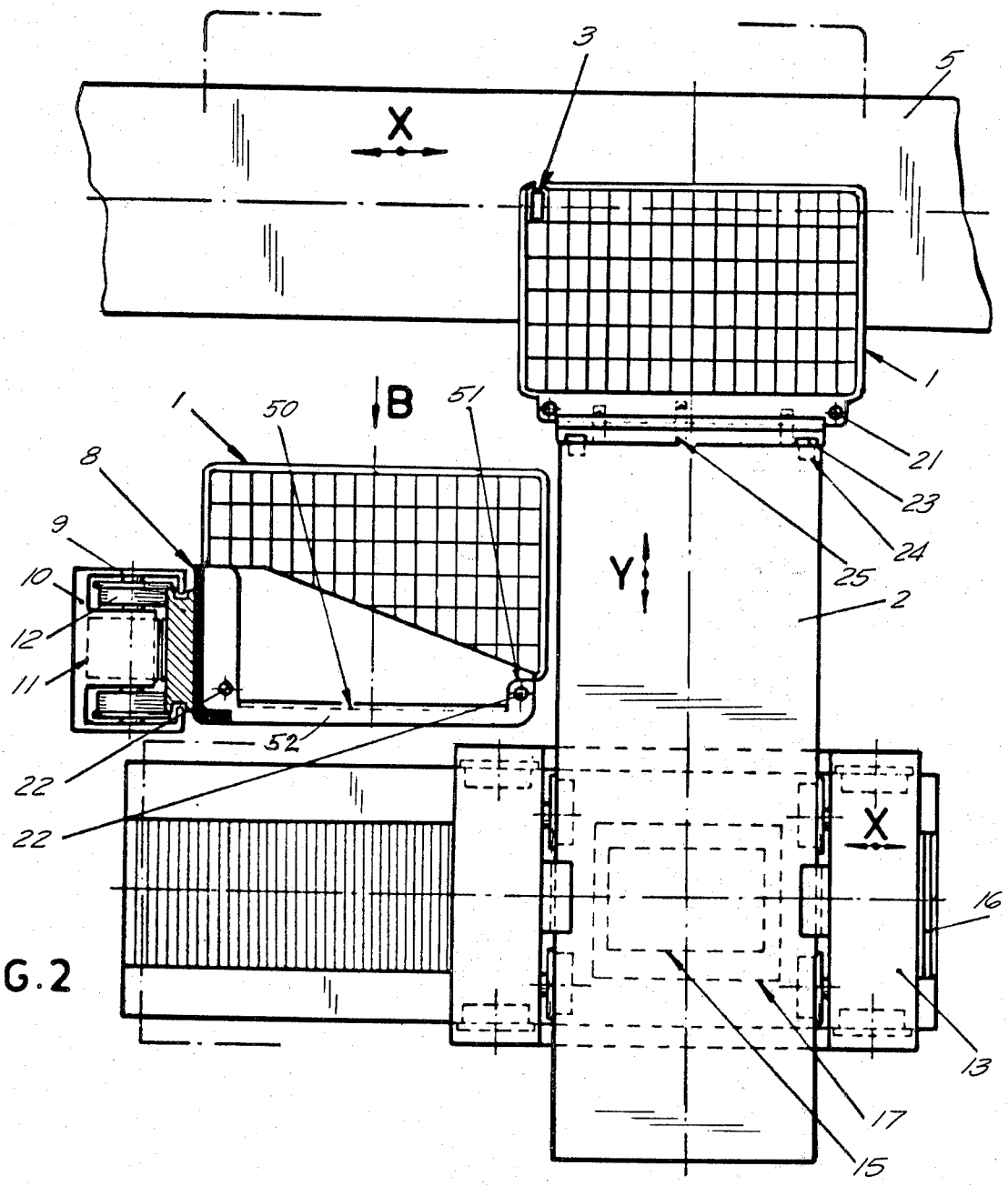
FIG. 2 is a view in end elevation of the character printer of FIG. 1, the view being taken in the direction A in FIG. 1.

Turning first to the embodiment of FIGS. 1–10, incl., in FIGS. 1 and 2 the printing device according to the present invention has a platen 5, acting as a support for a print-out carrier (paper) 7 which is movable in the direction of the line being printed, while a hammering device 4, which contains a printing hammer 3 and a ribbon 6, is affixed to the body (not shown) of the printer. A plurality of printing cards are stored in a cartridge 8.

One selected printing card 1 pulled-out of the cartridge 8 is clamped by the manipulator 2, which is carried and positioned along the horizontal line X by a carriage 13 and is independently positioned along the vertical line Y. The printing hammer 3 of the hammering device 4, which also contains the ribbon 6, can react to a suitable signal and hit the printing character 39 (FIGS. 5, 6, and 7) positioned in front of it, from the operating selected printing card 1 and, through the ribbon, to leave a print-out on the print-out carrier, the paper 7.

The hammering device 4, containing the printing hammer 3 and the ribbon 6, is known and does not need any detailed description.

The printing card 1, shown in detail in FIGS. 1, 5, 6, and 7, has a flat rectangular printing zone 31 and a bearing or connecting zone 32 disposed beneath zone 31. The printing zone 31 can be designed in such a way as to contain a specific number of printing characters, for example 48 to 96 characters, which are disposed in vertical columns and horizontal rows parallel to the sides and bottoms and tops, respectively, of the printing card 1. The components 28 and 29 of the printing zone 31, as well as the frame part 30 (FIGS. 5, 6 and 7) can be made of plastic material; the frame part 30 can be made, for example, of polyurethane elastomer. The printing surfaces of the printing characters 29 can be metallized in order to improve the life of the characters and the quality of the print-out. The back part of the printing characters 29, which is hit by the hammer, can be designed in such a way as to insure its orientation and centering with respect to the printing position by interfitting with the impacting surface of the printing hammer 3 during the printing process. The bearing zone 32 has elements 23 made of magnetic material and sockets for connecting pins 27 (FIGS. 2 and 8), which are attached to the manipulator 2. Through these elements orientation, centering and clamping of the selected printing card 1 by the manipulator 2, which interacts through magnetic elements 24, made of permanent magnetic material, and the pins 25 is insured.

The term "magnetic material", used in this description, means a material which can be drawn by a permanent magnet and which can be made a permanent or a temporary magnet when placed in a magnetic field.

In the bearing zone 32 of the printing card 1, there are disposed elements 21 made of magnetic material, as well as two depending end flanges 26 having vertical confronting edges which accurately receive the upper edge of the printing card between them. These elements insure the centering and holding of each printing card 1 into the cartridge 8, which interacts through its own elements 22, made of permanent magnetic material, and the right-angled sockets 50 (FIGS. 2, 3, and 4), disposed in the bottom, wider part 52 of the spaced parallel ribs or partitions 27 of the cartridge 8.

The carriage 13 can move along the strip 16, which is disposed parallel to the direction X, parallel to the printed line, and which is fixed to the body of the printing device (not shown). The motor for driving and positioning the carriage 13 can be a linear step electric motor of the type known as "Sawyer". The moving or active part 17 of such motor is built into the carriage 13, while the fixed strip 16 functions as the stator or secondary part of such motor. The primary part 15 of another linear step electric motor is built into the carriage 13, the stator or secondary part of such motor, which insures the positioning of the manipulator 2 in the direction Y is built into the body of the manipulator.

From here on, the primary, or active, part of the linear step electric motors, mentioned above, will be called "motor", while the secondary, inactive, part will be called "strip" or "manipulator".

On the carriage 13 there are mounted two sets of wheels 14 and 18 which guide the manipulator 2 and the carriage 13, respectively. The presence of built-in permanent magnets in the linear step electric motors insures continuous contact between the sets of wheels 14 and 18 and the corresponding surfaces of the manipulator 2 and the strip 16. In order to prevent possible disruption of such contact, stops 19 and 20 are employed between the moving and fixed parts of the device.

Figure 3:
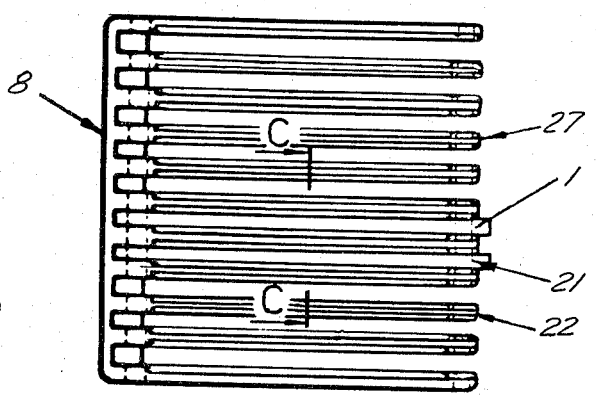
FIG. 3 is a view in section of the cartridge, the view being taken along the line B in FIG. 2.
Figure 4:
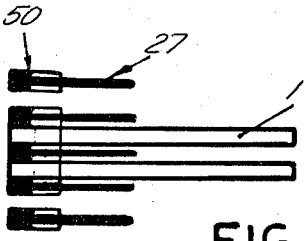
FIG. 4 is a view in cross-section taken along line C—C in FIG. 3.

The cartridge 8 has one vertical wall, through which it is affixed to the movable strip 9, and a number of spaced parallel ribs or partitions 27. In the lower part of each rib 27 there is widening into which there are machined one or two right-angled sockets 50 (FIGS. 2, 3 and 4). Each rib has two elements 22 made of a permanent magnet associated therewith. Each of the printing cards 1 is centered or aligned and held by the sockets 50 and the elements 22.

At one of its ends, the socket 50 could be closed through an edge 51 of the wider part 52 of the rib 27, in order to insure the fixed positioning of the printing cards 1 in the direction to the right along the line X (FIG. 2).

The limited mobility of the cartridge 8 along the line Z is insured by a set of guiding wheels 12 which are mounted on a fixed bracket 10. Proper positioning of the cartridge 8 is insured by the interaction between the motor 11 built into the bracket 10 and the bearing strip 9 for such motor.

The manipulator 1 is designed in such a way as to be able to enter into the carriage 8 from below, into the space between successive ribs 27, to clamp one specific printing card and to position it along the lines X and Y.

FIG. 4, which is a section of the cartridge 8 taken along the line C—C of FIG. 3, shows a number of ribs 27 and two printing cards 1, the printing cards being affixed between the ribs due to the interaction between the elements 50 and 22 of the cartridge 8 and the elements 26 and 21 of (FIGS. 1 and 2) of the printing card 1.

Figure 6:
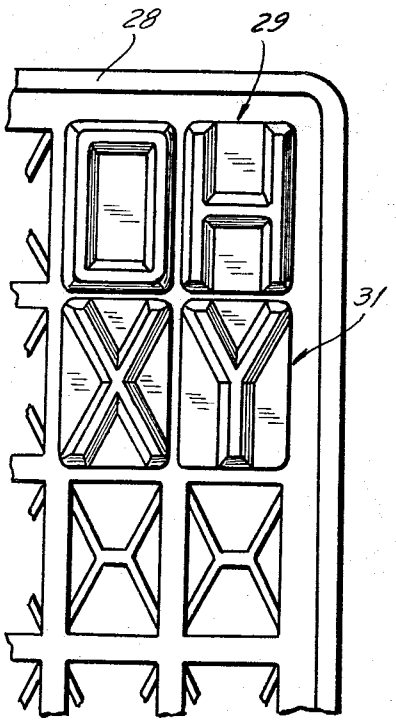
FIG. 6 is a partial view in elevation in the direction P in FIG. 5.
Figure 5:
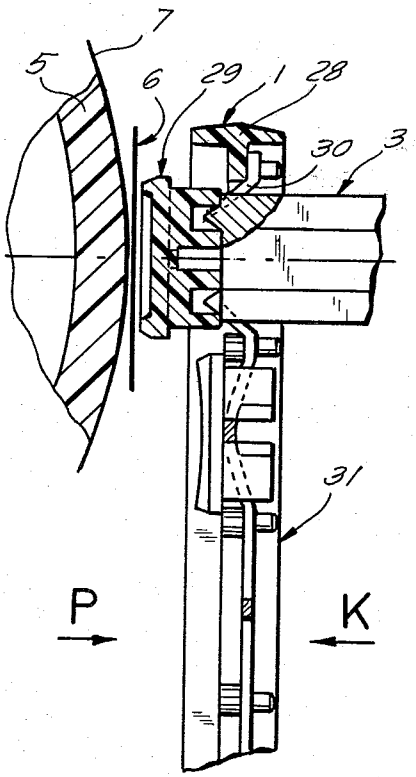
FIG. 5 is an enlargement of zone E in FIG. 1 during the action of the printing hammer.
Figure 7:
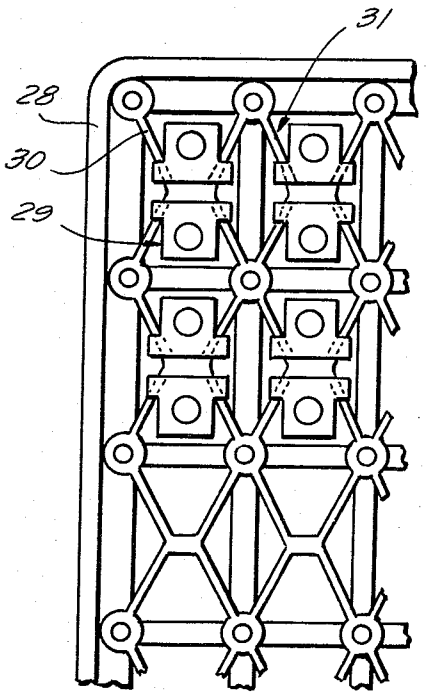
FIG. 7 is a partial view in elevation in the direction K in FIG. 5.
Figure 10:
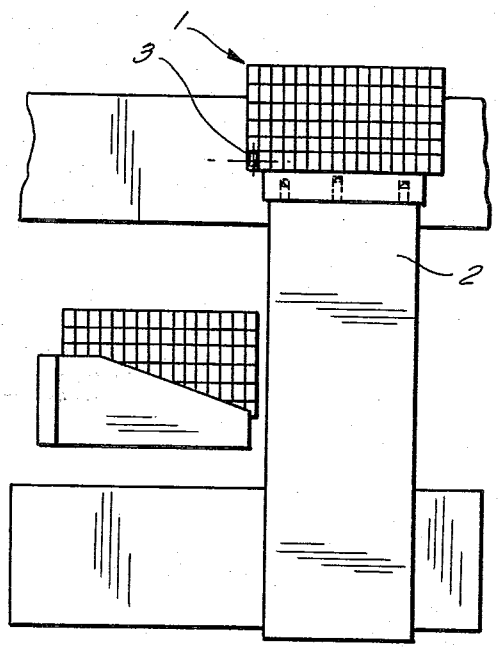
FIG. 10 is a view similar to FIG. 8, but showing the manipulator as having moved from the position shown in FIG. 9 so that it is now positioned horizontally by means of the carriage 13 in its furthest right position wherein the printing character in its left position of the bottom row can be printed by the hammer.
Figure 9:
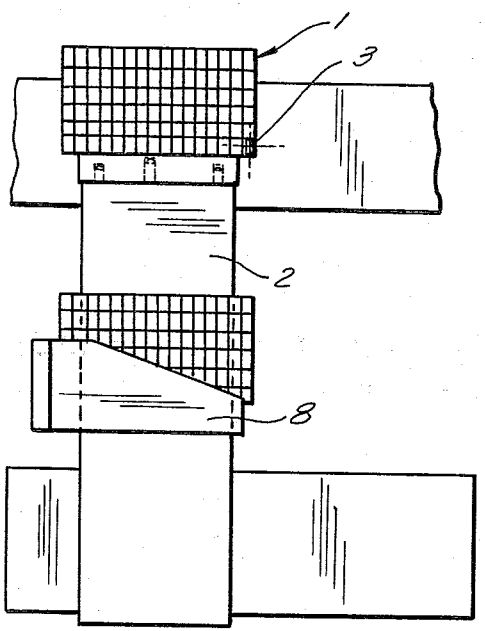
FIG. 9 is a view similar to FIG. 8, but showing the manipulator moving upwards from the position shown in FIG. 8; the manipulator; after clamping one printing card from the cartridge, has reached its uppermost position, and the furthest right printing character on the bottom row of the printing card can be printed-out after activation of the hammer.
Figure 8:
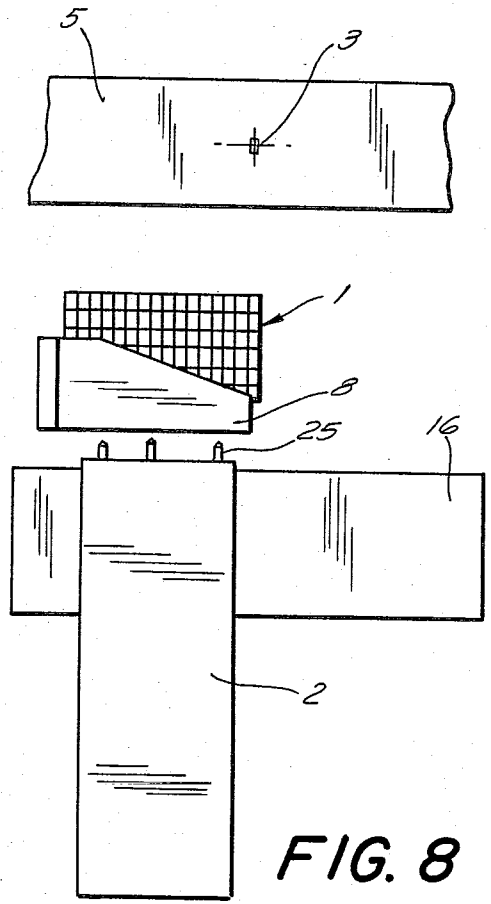
FIG. 8 is a simplified view taken along line A in FIG. 1 showing a condition wherein the manipulator is in its lower position and is entirely outside the cartridge.

FIGS. 5, 6 and 7 are enlargements of one sector of the printing zone 31 of a printing card 1. Such zone 31 could also be that of the printing card 101 of the second embodiment shown in FIGS. 11, 12 and 13. The frame 28 of the printing card carries the printing characters 29 through the elastic elements 30.

The manner of operation of the first disclosed embodiment of the printing device of the invention is as follows:

It will be apparent from the above that the platen 5 is movable along the line X and that the printing hammer 3 is fixed. The printed line is defined by the movement of the platen 5 which carries the paper 7 along the line X, and by the positioning of the manipulator 2 with respect to the hammer 3 in the plane X-Y. The cartridge 8 is fixed along the direction X; it can perform positional movements only in the direction Z. The positioning of the manipulator 2 carriage, which is carried by the carriage 13, within the plane X-Y, is performed by the motors 17 and 15, the motor 17 positioning the carriage 13 and by this the manipulator 2 along the line X, while the motor 15 positions the manipulator 2 directly along the line Y. Positioning of the cartridge 8 along the line Z is performed by the motor 11.

The taking out of a specific printing card 1 from the cartridge 8 and its inclusion as an operating printing card is carried out after a specific command, and as a result of it the manipulator 2 moves to the left and/or down (FIG. 2) in order to replace the printing board which is being replaced into its position in the cartridge. The release takes place after the edges 26 (FIG. 1) of the two side flanges in the bearing zone of the printing card 1 come to rest in the right-angled sockets 50 (FIGS. 2 and 3) and by continuous downward motion of the manipulator 2 until the magnetic forces between the elements 23 and 24 are overcome. As a result, the printing card 1 will remain in the cartridge, held by the magnetic force between its magnetic elements 21 and the magnetic elements 22 fixed on the ribs 28 which shape the corresponding socket of the cartridge. Moving downwards the manipulator 2 will reach its lowest position (FIG. 8), in which it is entirely outside the cartridge 8. In this position, the cartridge 8 will perform the necessary positioning of the printing card 1 along line Z, in order to feed to the manipulator 2 the printing card 1 which has been defined by the command. This will be achieved by placing the printing card 1 defined by the command above the manipulator 2.

Moving upwardly, the manipulator 2 will orient and align with the printing card 1 through the pins 25 (FIG. 8), and after its elements 24 reach the elements 23 which are attached to the printing card 1, magnetic clamping will be achieved of the now operational printing card 1. At the next moment, overcoming the magnetic forces between the elements 21 and 22, which hold the printing card 1 to the bottom of the cartridge, the manipulator will continue moving upwardly carrying the operational printing card until it reaches its static working position from which it can execute a command for the positioning of a specific printing character. The position of the operating printing card in the static working position can be such as to allow for visual access to the line being printed. For this purpose, the top row of the printing characters of the operating printing card can be placed at a specific minimal distance under the printed line.

The printing of a specific character in a position defined through the corresponding positioning of the platen 5 along the line X, is connected with the positioning of the operating printing card 1 within the plane X-Y, situated between the face of the printing hammer 3 and the ribbon 6. This is achieved by the simultaneous movement of the carriage 13 and the manipulator 2, whereby the positioning by the carriage 13 of the column wherein the selected character is situated is achieved, while the row which contains the selected character is positioned by the manipulator 2. As a result of the positioning movements, the desired printing character is placed in front of the printing hammer 3 which then by hitting the character and acting through the ribbon 6 produces the corresponding print-out on the paper 7. Immediately after printing, the operating printing card can take its static working-position through the corresponding movements of the carriage 13 and the manipulator 2, by which to allow visual access to the line being printed and to get the machine ready for the positioning of another printing character.

The second disclosed embodiment of the character printing device of the invention is shown in FIGS. 11–13, and 16. In such embodiment, the platen 5 which bears the paper 7 is fixed in the direction of the printed line, while the hammering device 4, containing the printing hammer 3 and the ribbon 6 is movable in that direction.

The selected, operating printing board 101 is carried by the manipulator 102, which itself when together with the cartridge 108 is carried by the carriage 110. The carriage 110 is movable in the direction of the line being printed, and is guided by the strip 116, which is affixed to the body (not shown) of the printing device. In the carriage 110 there are built in three motors, 111, 115, and 117, and for each of such motors there are mounted three sets of guiding wheels 112, 114, and 118. These three motors insure movement of the respective parts in three mutually perpendicular directions:

The motor 115 positions the manipulator 102 along the line Y, the motor 117 positions the carriage 110 along the line X, while the motor 111 positions the cartridge 108 along the line Z through the strip 109, to which it is affixed.

The cartridge 108 is open on two sides, the open sides being the top and the bottom. Along the inside walls of the left and right-hand sides of the cartridge there are channels 127, which serve to insure that a proper distance is maintained between successive and to guide the printing cards 101 when they are placed in or taken out of the cartridge by the manipulator 102. For holding the printing cards 101 placed in the cartridge 108 to the bottom of the cartridge 108, there are provided two elements 122 made in the form of a permanent magnet, and in the bearing zone of each printing card 101 there are two magnetic elements 121. In a manner similar to the device shown in FIGS. 1–4, incl., here also the manipulator 102 and the printing cards 101 have elements 123, 124 and 125, through which the centering of alignment, the orientation and the holding of the selected, operating printing card 101 by the manipulator 102 are insured.

The hammering device 4 is positioned on the fixed strip 142 through the carriage 140, which has a built-in motor 141, a set of wheels 143, and elements 144 which insure that the mechanical contact between the carriage 140 and the strip 142 is always maintained.

The manipulator 102 is designed in such a way as to be able to enter the carriage 108 from below, and after clamping a specific printing card to be able to position it along the line Y, moving in the space freed by it in the cartridge.

The device of FIGS. 11–13, incl., operates as follows: The line being printed is defined by the positional movement along the line X of the printing hammer 3, combined with the positional movement within the plane X-Y of the manipulator 102. The coordinated positioning of the manipulator 102 is defined by the variable along the line X of the printing hammer 3. The cartridge 108 moves along the line X together with the manipulator 102, and has an independent positional movement along the line Z. The hammer 3, which is contained in the hammering device 4, is positioned along the line X by the motor 141, while the manipulator 102, which is carried by the carriage 110, is positioned within the plane X-Y by the motor 117, which positions the carriage 110 along the line X, and by the motor 115, which positions it directly along the line Y. The positioning of the carriage 108 along the line Z is accomplished by the motor 111.

A specific printing card 101 is taken out from the cartridge 108 and is used as an operating printing card after a specific command is issued. As a result of such command, the manipulator 102 moves downwardly, in order to release the printing card 101 being replaced, and leaves such card in its position within the cartridge 108. Releasing the printing card being replaced is achieved after the elements 121, on the bearing zone of the printing card come to rest on the elements 122, disposed on the inside wall of the bottom of the cartridge 108, and after overcoming the magnetic forces between the elements 123 and 124, which insure the holding of the printing card by the manipulator. Further movement of the manipulator 102 will bring it entirely out of the cartridge 108, and it will stop in its lowest position, in a manner analogous to that above described with reference to FIG. 8.

In this position, the manipulator 102 allows the cartridge 108 to perform the necessary positioning along the Z line in order to present to the manipulator 102 the newly selected printing card 101. The card being replaced is held in its position due to the magnetic forces between its elements 121 and the elements 122 of the cartridge 108. After the positioning of the cartridge 108 so that the selected printing card 101 is placed above the manipulator 102, the manipulator moves upwardly along the line Y entering the cartridge 108 from below, the orientation and alignment of the selected printing card 101 being attained through the pins 125, the magnetic clamping of the printing card being accomplished through the interaction of the elements 123 and 124 on the printing card and the manipulator, respectively. The overcoming of the magnetic forces between the selected card and the cartridge, as a result of the interaction between the elements 121 and 122, takes the selected printing card out of the cartridge and places it in its static working position.

The printing of the selected character in a position which is defined by the corresponding positioning along the line X of the printing hammer 3 is connected with the positioning of the operational printing card 101 with respect to the position of the printing hammer. This is achieved, as in the previously described embodiment, by the positioning of the operating printing card 101 and the X-Y plane, situated between the face of the printing hammer 3 and the ribbon 6. Positioning along the line X is insured by motor 117, which moves the carriage 110 and positions the column which contains the desired character. Positioning of the printing card along the line Y is achieved by the motor 115, which directly positions the manipulator 102, so that the row which contains the desired character in the printing card is positioned at the required level. As a result of the simultaneous motion of positioning along the line X and along the line Y, the desired printing character is placed under the printing hammer which, when activated, acts through the desired printing character and the ribbon 6 on the paper 7 to effect the desired print-out. Immediately after, there follows the return of the operating printing card to its static working position, from which it can be positioned again or replaced by another printing card which is in the cartridge 108.

Figure 14:
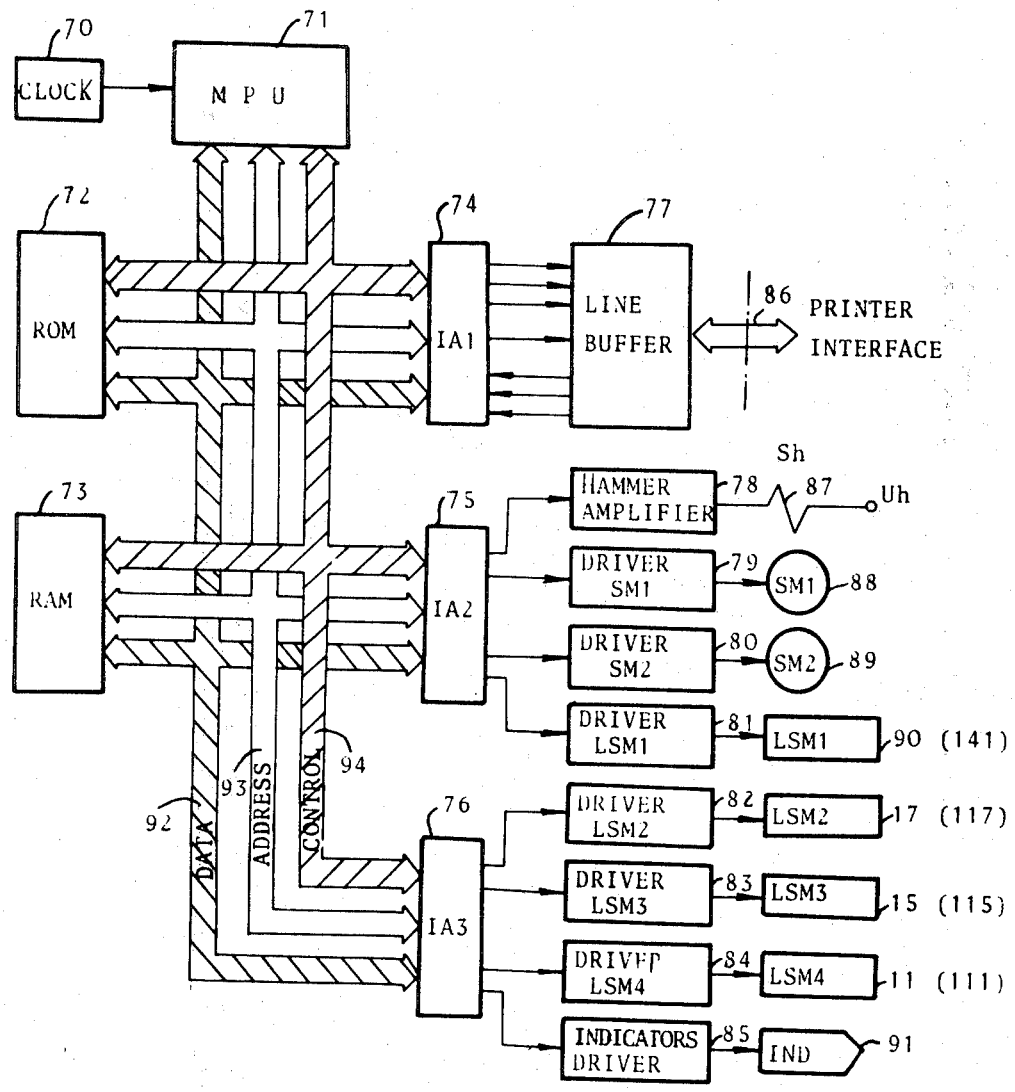
FIG. 14 is a block diagram of the controller for the printing device of the invention.
Figure 15:
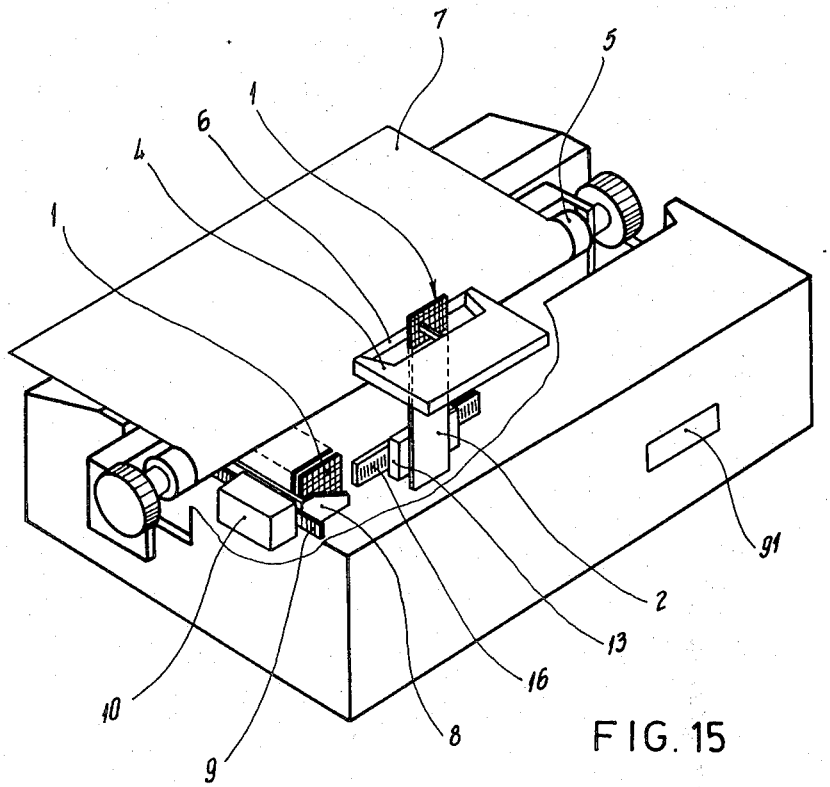
FIG. 15 is a view in perspective of a first embodiment of the printing device of the invention, such embodiment being that shown in FIGS. 1–10; incl.
Figure 16:
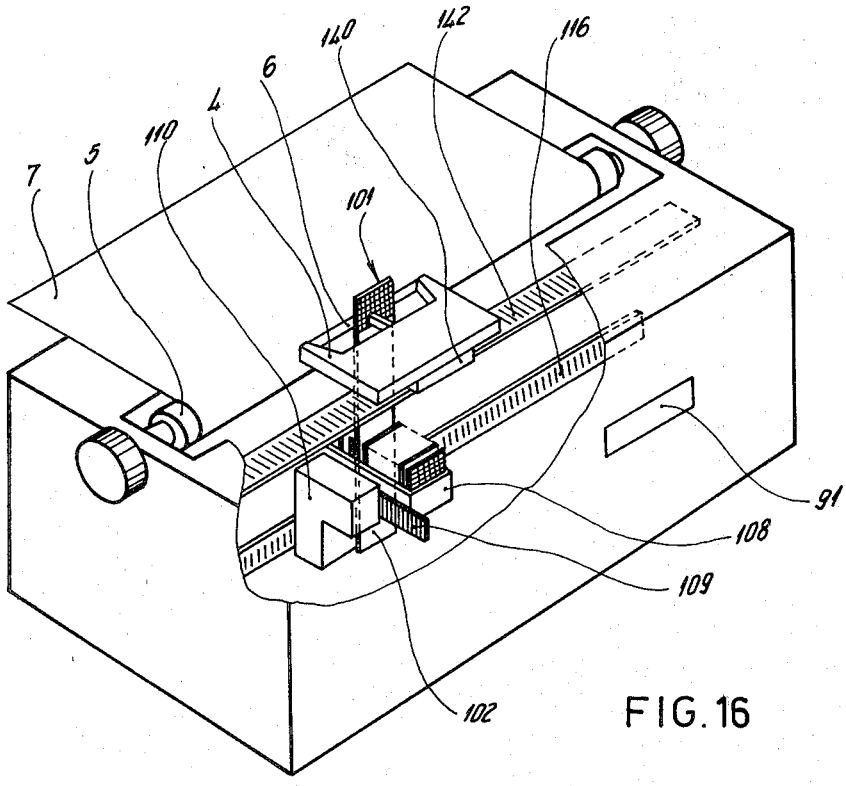
FIG. 16 is a view in perspective of a second embodiment of the printing device of the invention.

FIG. 15 is a general view in perspective of the first disclosed embodiment of the device, which is particularly shown in FIGS. 1 and 2. In FIG. 14, there is shown the block-diagram of the controller for the printing device which is shown in FIGS. 1 and 2. It consists of a micro-processor unit MPU 71, connected through the buses DATA 92, ADDRESS 93, and CONTROL 94 to read only memory ROM 72, random access memory RAM 73 and interfere adapters IA1 74, IA2 75, and IA3 76. A pulse generator CLOCK 70 is attached to MPU 71, such clock providing the clock of the controller. To IA1 74 there is attached the buffer cicuitry LINE BUFFER 77, which determines the electric characteristics of the PRINTER INTERFACE 86. To IA2 75 there is attached a HAMMER AMPLIFIER 78, which powers the coil sh 87 of the hammer 3. To IA2 75 and IA3 76 there is attached the circuitry for the control and driving of the step-motors, as follows:

DRIVER SM1 79—circuitry for control and driving of the rotational step-motor SM1 88, which rotationally positions the platen 5;

DRIVER SM2 80—circuitry for the control and driving of the rotational step-motor SM2 89, which moves the colored ribbon 6;

DRIVER LSM1 81—circuitry for the control and driving of a linear step-motor LSM1 90 (141), which is for the horizontal positioning of the platen 5;

DRIVEN LSM2 82—circuitry for the control and driving of a linear step-motor LSM2 17, which is for the positioning of the printing card 1 along the direction X;

DRIVER LSM3 83—circuitry for the control and driving of a linear step-motor LSM3 15, which is for the positioning of the printing card 1 along the direction Y;

DRIVER LSM4 84—circuitry for the control and driving of a linear step-motor LSM4 11, which is for the positioning along the direction Z of the cartridge 8 with the set of printing cards 1; and INDICATORS DRIVER 85—circuitry for control of the block indicator 91, which indicates the type of the printing card, register, etc.

The controller of the printing device is program controlled. The control program and the translation tables, necessary for the operation of the device, are written in the ROM 72. Monitoring of the linear position of the step motors is accomplished by the contents of the reversible counters, which are reset, after specifying the initial position of the motors, at every switching-on of the power supply. The current content of these counters, the codes of the characters to be printed obtained through the PRINTER INTERFACE 86, information about the type of the printing card, register, and position of the printed character and other current data are kept in the random access memory RAM 73. The MPU 71 processes the interrupts from the PRINTER INTERFACE 86 and, taking into account the contents of ROM 72 and RAM 73, through IA2 and IA3 generates the control signals for HAMMER AMPLIFIER 78; DRIVER SM(1-2) 79, 80; DRIVER LSM (1-4) 81, 82, 83, 84 and INDICATORS DRIVER 85.

The functioning of the printing device is, as follows:

1. Initial reset (RESTORE)

When the power is switched-on the linear step-motors sequentially move to their initial positions:

LSM1 90 moves into its rightmost position, where the platen is against the hammer of the first position;

LSM2 17 moves into its leftmost position, where the manipulator 2, which holds the printing card, enters the cartridge 8;

LSM3 15 moves into its lowermost position, while the printing card remains in the cartridge 8;

LSM4 11 moves into the first position, where the cartridge 8 gets in the initial position;

the content of the indicators 91 is reset.

2. Selection of a printing card

The command for printing card selection, which is issued through the PRINTER INTERFACE, causes sequential movement of the following linear step-motors:

LSM4 11 moves to the position of the desired printing card;

The indicator 91 shows the type of printing card positioned by the cartridge 8;

LSM3 15 moves upwards, takes the printing card out of the cartridge 8 and stops some distance below the printed character in order to allow for visual access to it—initial state for positioning the printing card along the direction Y;

LSM2 17 moves to the right until the leftmost column of the printing card is placed against the hammer—initial state for positioning of the printing card along the direction X.

3. Selection of position for printing a character

LSM1 90 moves the platen 5 a specific number of steps and stops it, at the position where the next character would be printed. The same motor moves the platen 5 during horizontal tabulation and its return.

4. Printing of a character

The following sequence is performed:

LSM2 17 and LSM3 15 position the printing card is such a way that the desired character in the corresponding register is placed in front of the hammer;

the hammer of coil sh 87 hits the character and prints it;

the step-motor SM2 89 moves the ribbon through one step;

LSM1 90 moves the platen one step to the left;

LSM2 17 and LSM3 15 return the printing card to its initial state along the directions X and Y.

5. Moving to a new line

SM1 88 rotates the platen one line up;

LSM1 90 returns the platen to the rightmost (initial) position.

Figure 11:
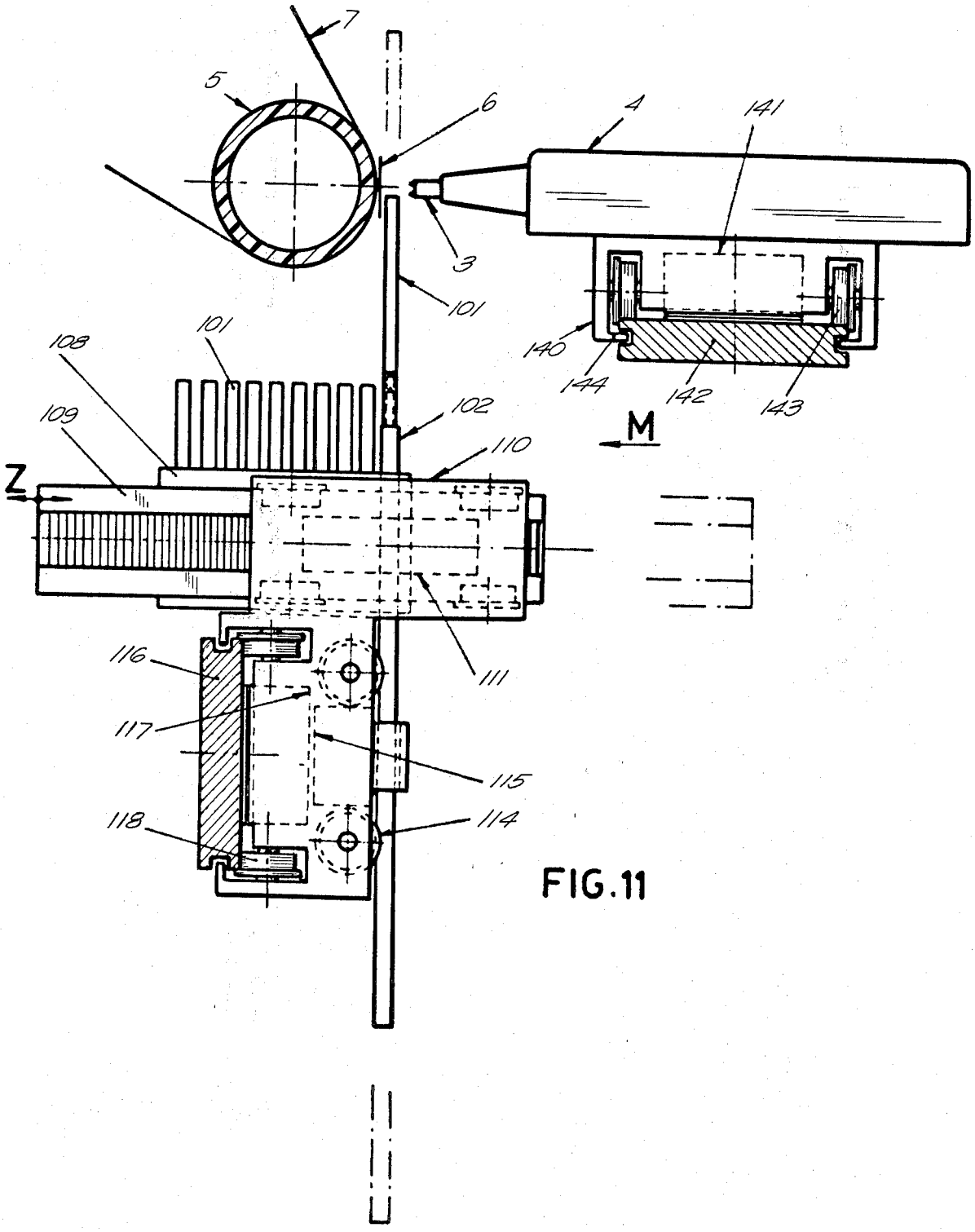
FIG. 11 is a view in side elevation of a second embodiment of the character printing device according to the present invention.
Figure 12:
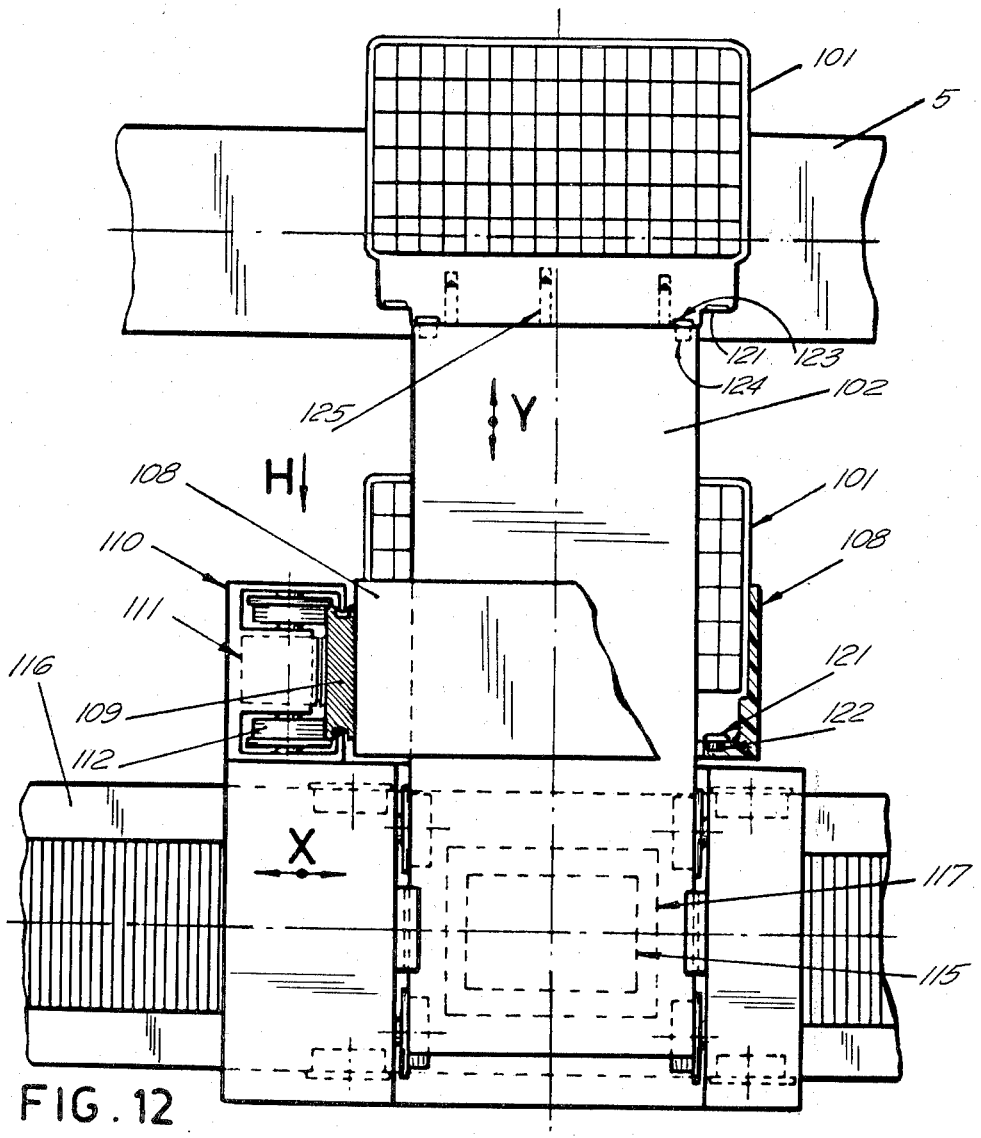
FIG. 12 is a view in elevation taken in the direction M in FIG. 11.
Figure 13:
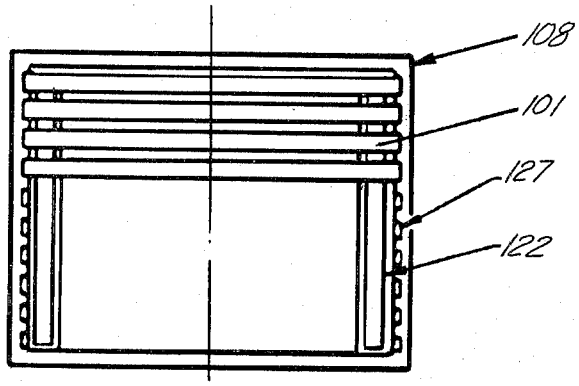
FIG. 13 is a view of the cartridge of the second embodiment taken in the direction H in FIG. 12.

The second embodiment of the device is shown in FIGS. 11-13, incl., and 16, wherein elements which are the same as those of FIG. 15 are designated by the same reference characters, and elements which are similar to, but modifications of those of FIG. 15 are designated by the same reference characters with 100 added to each.

With the aid of FIG. 14 it is possible to explain the controller of the second embodiment of the printing device, which contains the same components and connections between the components as in the first embodiment. The functional designation of the motors is identical with the exception of the linear step-motor LSM1, which in the first embodiment positions the platen 5 horizontally, while in the second embodiment (horizontally fixed platen) positions the hammering device 4 along the length of the printed line. The control programs, which are in the ROM, are different, but in this case the monitoring of the linear step-motor positions is also accomplished by the content of the reversible counters.

The functioning of the second embodiment is as follows:

1. Initial reset (RESTORE)

When the power is switched-on the step-motors return to their initial positions in the following sequence:

LSM1 141 moves the hammering device 4 into the leftmost position, where the hammer is placed in the first position of the line against the platen;

LSM2 117 moves the cartridge 110 to the leftmost position, wherein the printing card 101 is placed in front of the printing hammer 3;

LSM3 115 moves the manipulator 102 to the lowest position, where the printing card 101 held by it remains in the cartridge 108;

LSM4 111 moves the cartridge 108 to its initial position;

the contents of the block indicator 91 are reset.

2. Selection of a printing card 101

The command, issued through the PRINTER INTERFACE for selection of a printing card, causes sequential movement of the linear step-motors:

LSM4 111 moves the cartridge 108 to the position where the desired printing card is situated:

the indicator 91 shows the type of the printing card positioned by the cartridge 108;

LSM3 115 moves the manipulator 102 upwardly, clamps and takes out of the cartridge 108 the desired printing card 101, which is positioned by the cartridge 108, and stops at a specific distance under the printed line, in order to allow for visual control—this is the initial position along the direction Y of the printing card 101, which is being used;

LSM2 117 moves the carriage 110 to the right until the leftmost column of the printing card 101 is placed against the hammer 3—initial position of the printing card along the direction X.

3. Selection of position for printing a character

LSM1 141 moves the hammering device 4 a specific number of steps and stops it at the position of the line, where the next character is to be printed. The same motor also moves the hammering device 4 during tabulation.

4. Printing of a character

The following sequence is followed:

LSM2 117 and LSM3 115 position the printing card 101, being used in such a way that the desired character from the corresponding register stops in front of the hammer 3;

the hammer 3, after activation of the coil sh 87, hits the positioned character and with the aid of the ribbon 6 inprints the character on the paper 7;

the step-motor SM2 89 moves the ribbon one position;

LSM1 141 moves the hammering device 4 one position to the right;

LSM2 117 and LSM3 115 return the printing card 101 to its initial positions along the directions X and Y.

5. Moving to a new line

SM1 88 rotates the platen 5 one line upwards;

LSM1 141 returns the hammering device 4 to the leftmost (initial) position.

The functioning of both embodiments of the printing device can also be arranged so as to combine some of the positioning motions in order to improve the printing speed of the device.

In the case when the codes of the characters to be printed are introduced automatically (without an operator and a keyboard) and visual access to the line being printed is not necessary, after the printing of the character from the card it is not necessary to return to the initial position along the directions X and Y; this improves the printing speed of the device.

Although the invention is illustrated and described with reference to a plurality of preferred embodiments thereof, it is to be expressly understood that it is in no way limited by disclosure of such a plurality of embodiments, but it capable of numerous modifications within the scope of the amended claims.

We claim:

1. A serial character printer, comprising in combination: at least two substantially flat printing cards having different sets of characters and signs thereon arranged in rows and columns, means for storing said printing cards including at least one cartridge for holding cards in stacked flat parallel condition, the cartridge having an opening at the bottom thereof, the cartridge having an opening at the top thereof to permit the insertion of cards into the cartridge and the withdrawal of cards through the opening in the top of the cartridge, means for the step-wise driving and positioning of a selected card in a lateral direction parallel to a line being printed and means for the step-wise driving and positioning of said selected card vertically perpendicular to said lateral direction in a plane parallel to the planes of said printing cards in the cartridge, said last named means including a card positioning manipulator having card clamping and aligning means on the top thereof which interfits with the bottom of a selected printing card, means for driving the manipulator upon command to place the manipulator with its top beneath the selected card in the cartridge and in alignment with the opening in the bottom of the cartridge, means for thereafter raising the manipulator through the opening in the bottom of the cartridge and then through the cartridge and out through the opening in the top of the cartridge to carry with it said selected printing card during successive printing operations and the respective positioning of the card at the printing station, means for lowering the manipulator to return the selected printing card into said cartridge through the opening in the top of the cartridge when the selected printing card is to be replaced by another printing card which is present in said cartridge, or when the printing operation is stopped, the means for driving the positioning manipulator laterally being a step-wise driven carriage upon which the manipulator is mounted, and the means for positioning the manipulator vertically being a step-wise driven driving means on said carriage, and comprising means for controlling said storage means and said positioning manipulator in cooperation with the respective step-wise driving means during the printing operation.

2. A serial character printer according to claim 1, wherein each printing card comprises: a flat rectangular frame therefor, printing characters arranged in rows and columns parallel to the sides, top, and bottom, respectively, of said frame and elastically attached to said frame, said frame having a bearing part at the bottom thereof containing means for selective interaction with said cartridge releasably to hold said printing cards therein and selectively to effect a connection between the clamping and aligning means on the top of the manipulator and a selected printing card, the clamping and aligning means on the manipulator and the means on the bottom of the cards for selective interaction with said clamping and aligning means on the top of the manipulator including at least one recess on one of the members comprising the top of the manipulator and the bottom of the cards and a pin selectively received in such recess on the other of said members comprising the top of the manipulator and the bottom of the card, the top of the manipulator and the bottom of the card also including a magnet on one of them and a magnet armature on the other of them, said magnet and armature constituting selectively releasable means connecting the card to the manipulator.

3. A serial character printer according to claim 2, wherein said means on said cartridge for holding and aligning said printing cards within said cartridge includes magnetic means.

4. A serial character printer according to claim 1, wherein said means for the lateral step-wise driving and positioning of said carriage comprises a first linear stepping electric motor acting to drive said carriage in a horizontal, lateral direction, and the means for the vertical step-wise driving and positioning said manipulator comprises a second linear stepping electric motor mounted on the carriage and driving the manipulator in a vertical direction.

5. A serial character printer according to claim 4, comprising a third linear stepping motor for the step-wise driving of the cartridge in a direction normal to the plane defined by the lateral movement of the carriage and the vertical movement of the manipulator whereby selectively to present the cartridge above the upper end of the manipulator for interaction between the manipulator and a selected card.

6. A serial character printer according to claim 5, wherein the primary parts of said first and second stepping electric motors are contained by and secured to said carriage, the secondary part of said first linear stepping electric motor providing motion of said carriage and positioning manipulator thereon in a lateral direction, parallel to the line being printed, and the primary part of said second linear stepping electric motor insuring motion of said manipulator in a vertical direction transverse relative to the line being printed.

* * * * *